United States Patent [19]

Ohmi

[11] Patent Number: 4,637,357

[45] Date of Patent: Jan. 20, 1987

[54] TAPPET ARRANGEMENT FOR ENGINE VALVE TRAIN

[75] Inventor: Masatoshi Ohmi, Iwata, Japan

[73] Assignee: Yamaha Hatsudoki Kabushiki Kaisha, Iwata, Japan

[21] Appl. No.: 728,094

[22] Filed: Apr. 29, 1985

[51] Int. Cl.[4] ..... F01L 1/14; F01L 1/26

[52] U.S. Cl. ..... 123/90.48; 123/90.27; 123/90.5

[58] Field of Search ..... 123/90.48, 90.27, 90.5

[56] References Cited

U.S. PATENT DOCUMENTS

| | | | |
|---|---|---|---|
| 1,374,059 | 4/1921 | Church | 123/90.48 |
| 1,820,299 | 8/1931 | Church | 123/90.5 |
| 2,207,324 | 7/1940 | L'Orange | 123/90.48 |
| 3,089,472 | 5/1963 | Thompson | 123/90.5 |
| 3,998,190 | 12/1976 | Keske | 123/90.5 |
| 4,448,155 | 5/1984 | Hillebrand et al. | 123/90.48 |

FOREIGN PATENT DOCUMENTS

| | | | |
|---|---|---|---|
| 296125 | 8/1928 | United Kingdom | 123/90.27 |

*Primary Examiner*—Ira S. Lazarus

*Attorney, Agent, or Firm*—Ernest A. Beutler

[57] ABSTRACT

A valve arrangement for an internal combustion engine that permits the use of a plurality of closely spaced valves. The valves are all directly actuated by means of thimble tappets that have non-cylindrical cross-sections so as to permit the tappet bodies to be positioned close to each other and yet afford a large area for their sliding support. The tappet bodies are also supported within the cylinder head assembly by means including a separate insert.

13 Claims, 5 Drawing Figures

TAPPET ARRANGEMENT FOR ENGINE VALVE TRAIN

BACKGROUND OF THE INVENTION

This invention relates to a tappet arrangement for an engine valve train and more particularly to an improved valve actuating construction for an internal combustion engine.

It has been recognized that the specific output of an internal combustion engine of a given displacement can be increased through the use of multiple valves for each combustion chamber. For this reason, many high performance engines now employ four valves (two intake and two exhaust) per cylinder of the engine. There are certain advantages that can be enjoyed by further increasing the number of valves. Obviously, however, there is a practical limit to the number of valves that can be used for a single combustion chamber. One of the limiting factors is the geometry of the valves and their actuating mechanism. That is, it is a common practice to operate the valves by overhead camshafts through the media of thimble tappets. However, as the number of valves is increased, the diameter of the thimble tappets that can be employed must be reduced and this reduces the bearing surface for the thimble tappets, which can present further problems.

It is, therefore, a principal object of this invention to provide an improved tappet arrangement for an engine valve train.

It is a further object of this invention to provide a tappet arrangement for an engine valve train that permits the use of a greater number of valves than previously proposed without sacrificing the bearing surface of the individual tappets.

When an engine is provided with a plurality of adjacent thimble tappers each of which operates a respective poppet valve, certain manufacturing difficulties may arise in conjunction with the formation of the openings in the body of the engine that slidably support the thimble tappets. This is particularly true if the thimble tappet has a cross-sectional configuration that is other than circular.

It is, therefore, a still further object of this invention to provide an improved arrangement for slidably supporting a plurality of thimble tappets in an engine body.

It is another object of this invention to provide a sliding support for a plurality of thimble tappets that may be conveniently and easily formed.

SUMMARY OF THE INVENTION

A first feature of this invention is adapted to be embodied in a valve arrangement for an internal combustion engine comprising a plurality of poppet valves that are supported for reciprocation between an opened position and a closed position. A camshaft is provided and a plurality of slidably supported tappets are each interposed between the camshaft and a respective one of the valves. In accordance with the invention, at least one of the tappets is non-circular in cross-section taken perpendicular to its line of reciprocation and has a short dimension extending in the direction of the adjacent valves and a long direction extending in the perpendicular direction.

Another feature of the invention is adapted to be embodied in a valve tappet arrangement for operating the valves of an internal combustion engine which comprises an engine body defining an opening. A pair of tappets are disposed within the opening and are adapted to be supported for reciprocation. Insert means are received within the opening and have respective surfaces that are slidably engaged with the tappets.

DETAILED DESCRIPTION OF THE PREFERRED EMBODIMENTS

Figure 1:
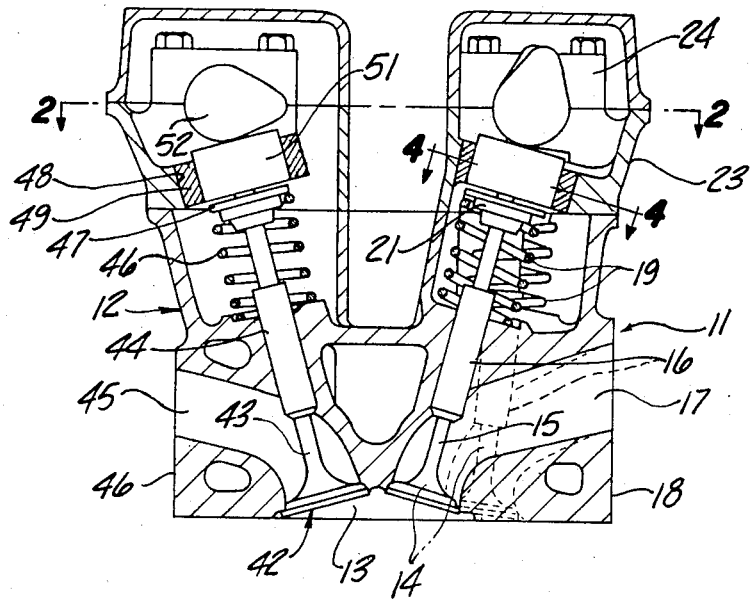
FIG. 1 is a cross-sectional view taken through the cylinder head assembly of an internal combustion engine constructed in accordance with the invention and generally along the line 1—1 in FIG. 2.
Figure 3:
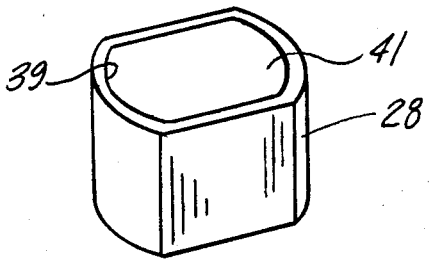
FIG. 3 is a perspective view showing the construction of one of the tappets.
Figure 2:
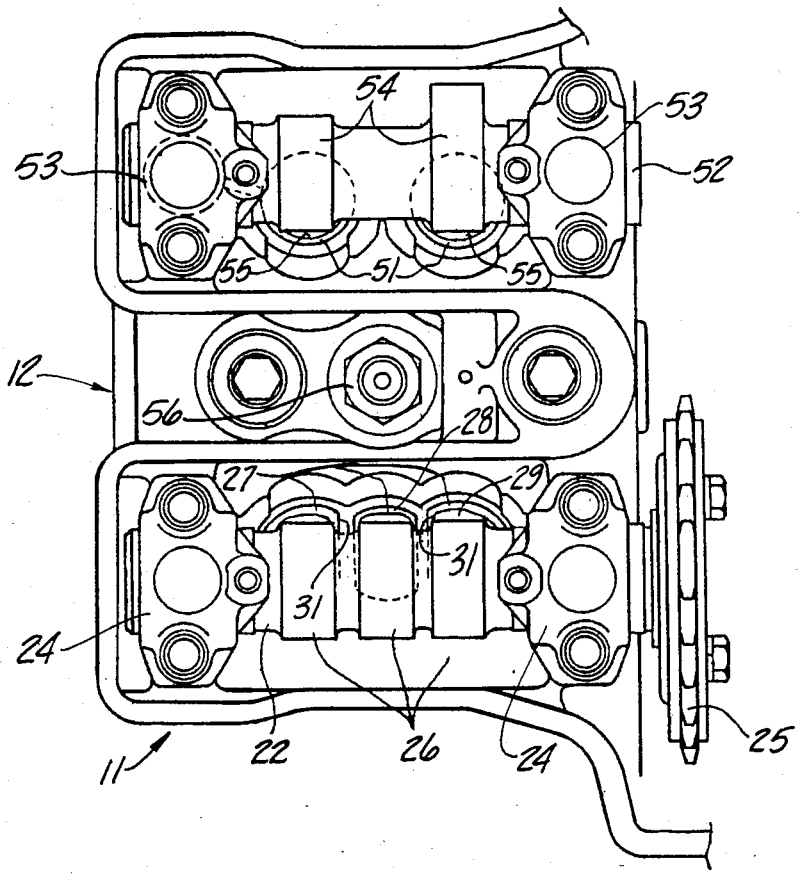
FIG. 2 is a view of the engine taken generally along the line 2—2 in FIG. 1.

As has been aforenoted, the invention is directly primarily toward the valve actuating mechanism and for that reason in the embodiments of the invention disclosed, only the portion of the engine associated with he valve mechanism has been illustrated in detail and will be described. The application of this principle to conventional reciprocating type engines is believed to be clear to those skilled in the art from this description. In addition, the construction associated with only a single cylinder has been illustrated and described because it is believed that it will be obvious to those skilled in the art how the invention can be practiced with engines having multiple cylinders and various cylinder configurations.

Referring now to FIGS. 1 through 4, an internal combustion engine constructed in accordance with a first embodiment is identified generally by the reference numeral 11. The engine 11 includes a cylinder block assembly (not shown) in which one or more cylinder bores are formed that reciprocally support pistons (not shown) that are connected to drive a crankshaft in a known manner. Because this portion of the engine is convention, it is not shown.

A cylinder head assembly, indicated generally by the reference numeral 12, is affixed to the cylinder block in a known manner and has a number of cavities or recesses 13 that cooperate with the cylinder bores and pistons to provide chambers of varying volume during the reciprocation of the pistons. These chambers and the cavities 13 will at times be referred to as the combustion chamber.

An induction system is provided for delivering a charge to the combustion chamber 13. This induction system includes a plurality, and in the illustrated embodiment, three, poppet type intake valves 14 that have stem portions 15 that are slidably supported in the cylinder head assembly 12 by means of respective valve guides 16 that are pressed into the cylinder head assembly 12. The intake valves 14 and specifically their heads control the flow of intake charge into the chamber 15 from respective valve seats and intake passages 17 that are formed in the cylinder head assembly 12 and which open through an outer face 18 of the cylinder head assembly 12. The intake passages 17 may be separate for each of the intake valves 14 or may be of the siamesed type. A suitable manifold (not shown) which may include a charge former is affixed to the face 18 for delivering the charge to the intake passages 17.

The orientation of the intake valves 16 is preferably of the form shown in copending application Ser. No. 369,665, filed Apr. 19, 1982, entitled "Four-Cycle Engine", and assigned to the assignee of this application, and specifically the embodiment of FIGS. 1 through 4 thereof. In view of the reference to this copending application, the detailed description of the preferred valve arrangement and geometrical relationship will not be repeated. Suffice it to say that the axes of reciprocation of the intake valves 14 and specifically their stems 15 all intersect at a line, for a reason to be described. The outer two valves reciprocate about parallel axes that are disposed at a greater angle to the axis of the associated cylinder bore than that of the remaining, intermediate intake valve.

Coil compression springs 19 encircle each of the valve stems 15 and engage the cylinder head assembly and keepers 21 affixed to the respective valve stems 15 for urging the intake valves 14 to their closed position.

A mechanism is provided for directly actuating the intake valves 14 for opening them against the action of the springs 19. This actuating mechanism includes an intake camshaft 22 that is supported by the cylinder head assembly 12, in a manner to be described, for rotation about an axis that coincides with the line that is intersected by the stems of the valves 14. For this purpose, a tappet body 23 is affixed to the remainder of the cylinder head assembly 12 in a known manner. Bearing caps 24 are affixed to the tappet body 23 and rotatably journal the intake camshaft 22. The camshaft 22 is driven in any suitable manner in timed sequence with the crankshaft of the engine and at one-half engine crankshaft speed, as is known in this art by means including a sprocket 25 affixed to one end of intake camshaft 22.

The camshaft 22 has three lobes, each identified by the reference numeral 26 that cooperate with respective tappets 27, 28, and 29. The tappets 27, 28 and 29 are, unlike those in the prior art, not cylindrical in configuration. The reason for a non-cylindrical configuration is so as to permit the intake valves 14 to be positioned closely adjacent each other and so as to afford substantial bearing area for the individual tappets 27, 28 and 29. The bearing area for their sliding support is considerably greater than would be possible if each of the tappets 27, 28 and 29 had the same configuration and were all circular.

Referring first to the outermost tappets 27 and 29, they have a generally cylindrical configuration except for the sides adjacent the tappet 28. These sides are truncated by means of a flattened section 31. Thus, the tappets 27 and 29 may be positioned very closely to the tappet 28. The tappets 27 and 29 are identical in configuration so that they are interchangeable with each other and each has a recess in its upper face so as to receive an adjusting shim. The tappets have a lesser dimension in the direction of the adjacent valve than in a perpendicular direction due to the presence of the flattened section 31. However, they have a greater surface area than if they were formed as cylinders having as their diameters this lesser dimension.

Figure 4:
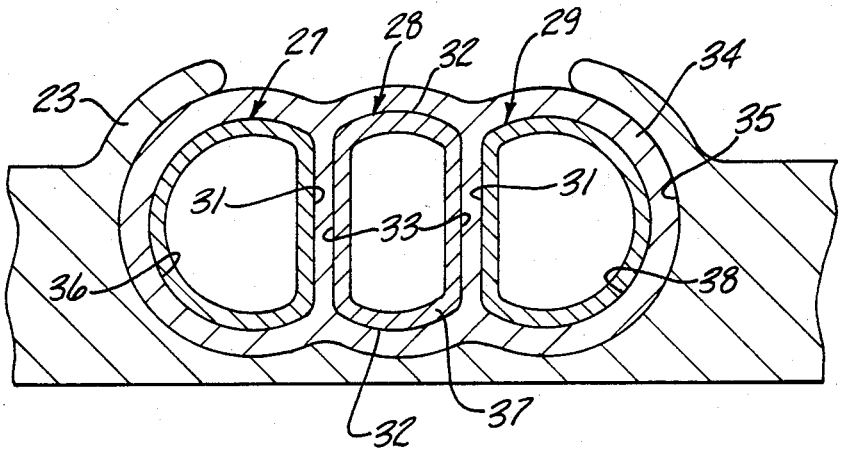
FIG. 4 is an enlarged cross-sectional view taken along the line 4—4 of FIG. 1.

The center tappet 28 has cylindrical sides 32 that are truncated by opposing flattened sides 33. The sides 33 extend parallel to the sides 31 so that the cross-sectional configuration of the tappet 28 is generally that of an oval as shown in FIG. 4. Like the tappets 27 and 29, this results in a lesser dimension in the direction of the adjacent valve or tappet and a greater dimension in the perpendicular direction. The tappet 28 has a greater surface area than a cylindrical one of the diameter of this lesser dimension.

It should be readily apparent that the described construction permits a good bearing area for each of the tappets 27, 28 and 29 but which nevertheless permits them to be placed quite closely to each other. Each tappet 27, 28 and 29 has a longer dimension in a direction perpendicular to the line extending between the adjacent tappets than in that direction. The close placement and large bearing area is possible in relation to an arrangement wherein each of the tappets were to have a cylindrical configuration as should be readily apparent from FIG. 4.

The tappets 27, 28 and 29 are slidably supported in the tappet body 23 by an insert 34 that is received within a specially formed opening 35 of the tappet body 23. The use of the insert 34 permits the opening 35 to be formed more conveniently and at a lower cost than would be possible if the tappet body 23 itself directly supported the tappets 27, 28 and 29. The insert 34 has respective openings 36, 37 and 38, each of which is complementary to the cross-sectional configuration of the tappets 27, 28 and 29, respectively.

The tappet 28, like the tappets 27 and 29, has a recess 39 formed in its upper end that is adapted to receive an adjusting shim 41 for clearance adjustment as is well known in this art.

On the side of the cylinder head assembly 12 opposite to the intake passages 17 and intake valves 14 there are provided a plurality of exhaust valves 42. In the illustrated embodiments, there are two exhaust valves 42 for each combustion chamber 13. The exhaust valves 42 are of the poppet type and have stem portions 43 that are supported for reciprocation wthin the cylinder head assembly 12 by pressed in valve guides 44. The heads of the exhaust valves 42 control the flow through exhaust passages 45 formed in the cylinder head 12 and which open through an outer face 46 for cooperation with an appropriate exhaust manifold.

The placement of the exhaust valves 42 relative to the intake valves 14 may also be as aforedescribed in copending application Ser. No. 369,665. Because there are only two exhaust valves per combustion chamber in relation to the three intake valves 14, the heads of the exhaust valves 42 have a larger diameter than the heads of the intake valves 14.

Coil valve springs 46 encircle the upper end of the stems 43 of the exhaust valves 42. The springs 46 act against the cylinder head assembly 12 and keepers 47 affixed to the valve stems 43 for urging the exhaust valves 42 to their closed positions.

The tappet body 23 is provided with an opening 48 that receives an insert 49 formed with bores that slidably support cylindrical thimble tappets or lifters 51 that cooperate with the valve stems 43. The thimble tappets 51 are actuated by an exhaust camshaft 52 that is supported by the cylinder head assembly 12 in a manner similar to the intake camshaft 22. That is, the camshaft 51 is journaled by the tappet body 23 and bearing caps 53 that are affixed to it in a known manner. The exhaust camshaft 51 has lobes 54 that are engaged with adjusting shims 35 carried by the thimble tappets 51 for actuating the exhaust valves 42 upon rotation of the exhaust camshaft 52. The exhaust camshaft 52 is driven in timed sequence with the crankshaft, in a manner similar to the intake camshaft 22 and which is well known in this art.

A spark plug 56 is supported by the cylinder head assembly 12 and is disposed generally centrally in the combustion chamber 13 for firing the charge in the combustion chamber.

Since there are only two exhaust valves 42 while there are three intake valves 14, it is possible to use cylindrical thimble tappets 51 for actuating the exhaust valves 43. If, however, more than two valves are utilized, a thimble tappet arrangement of the type as described in conjunction with the intake camshaft 22 and intake valves 14 may also be employed for the exhaust valves 42. However, like the thimble tappets 27, 28 and 29, the thimble tappets 51 are all slidably supported not directly by the tappet body 23 but rather by an insert 49. As with the intake thimble tappets, this arrangement may facilitate machining.

Figure 5:
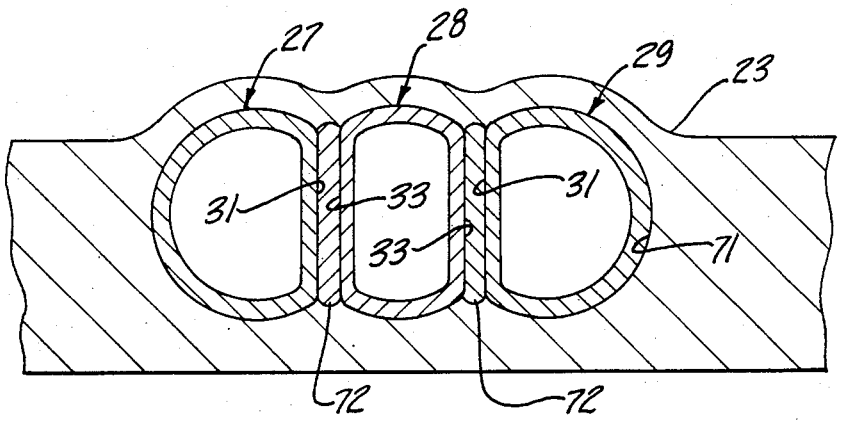
FIG. 5 is a cross-sectional view, in part similar to FIG. 4, and shows a further embodiment of the invention.

FIG. 5 shows another embodiment of the invention wherein a slightly different insert arrangement is employed. In this embodiment, the tappet body 23 is formed with a completely closed opening 71 rather than a partially closed opening 35 as with the embodiment of FIGS. 1 through 4. The thimble tappets 27 and 29 are directly supported at their cylindrical portions within the opening 71 and, therefore, it has a configuration chosen for this purpose. In a like manner, the cylindrical portions of the thimble tappet 28 are directly engaged with the walls of the tappet body 23 in which the opening 71 is formed. However, there are interposed inserts 72 between the surfaces 31 of the thimble tappets 27 and 29 and the corresponding surfaces 33 of the thimble tappet 28. Thus, rather than using a complete insert for forming the entire bearing area, this embodiment only uses smaller inserts. This embodiment has the further advantage of offering possible reduced machining costs.

Although a number of embodiments of the invention have been illustrated and described, various changes and modifications may be made without departing from the spirit and scope of the invention, as defined by the appended claims.

I claim:

1. In a valve arrangement for an internal combustion engine comprising a cylinder head assembly, a plurality of poppet valves supported by said cylinder head assembly at one side thereof for reciprocation between opened and closed positions, said valves being juxtaposed to each other, a camshaft, and a plurality of slidably supported tappets supported by said cylinder head assembly and each interposed between said camshaft and a respective one of said valves, the improvement comprising at least one of said tappets being non-circular in cross-sections taken perpendicular to its line of reciprocation and having a short dimension extending in the direction of the adjacent valves and a long dimension extending in the perpendicular direction, the distance between said valves being less than said long dimension.

2. In a valve arrangement as set forth in claim 1 wherein the cylinder head assembly comprises a cylinder head that slidably supports the valves and a tappet body affixed to the cylinder head and supporting the tappets.

3. In a valve arrangement as set forth in claim 1 wherein there are three valves and the valves all serve the same function.

4. In a valve arrangement as set forth in claim 3 wherein the valves have non-parallel axes.

5. In a valve arrangement as set forth in claim 4 wherein the axes of the valves all intersect at a common point.

6. In a valve arrangement as set forth in claim 5 wherein the common point of intersection of the valve axes lies coincident with the axis of rotation of the camshaft.

7. In a valve arrangement as set forth in claim 1 wherein adjacent tappet bodies have flattened surfaces extending parallel to each other.

8. In a valve arrangement as set forth in claim 7 wherein the portions of the tappet bodies not adjacent to each other are semi-circular in cross-section.

9. In a valve arrangement as set forth in claim 8 wherein there are three valves and three tappet bodies, the central tappet body having parallel flattened sides connected by curves sections and the remaining tappet bodies have semi-cylindrical sides flattened adjacent to the central tappet body.

10. In a valve arrangement as set forth in claim 1 wherein the tappets have an insert interposed therebetween.

11. In a valve arrangement as set forth in claim 1 wherein the tappet bodies are slidably supported by a body of the cylinder head assembly formed with an opening therein and an insert received within the opening and engaging adjacent sides of the tappet bodies for their slidable support.

12. In a valve tappet arrangement for operating the valves of an internal combustion engine comprising an engine body defining a continuous opening, a pair of tappets disposed in said opening, having flat sides, and adapted to be supported for reciprocation, a single insert received within said opening and having respective surfaces engaged with said flat sides of said tappets for forming a bearing surface therefor.

13. In a valve tappet arrangement as set forth in claim 12 wherein the tappets have surfaces that are engaged with the engine body and other surfaces that are engaged with the insert.

* * * * *